US011325754B2

(12) United States Patent
Svechin

(10) Patent No.: US 11,325,754 B2
(45) Date of Patent: May 10, 2022

(54) DISPENSING MECHANISM FOR CARBONATED BEVERAGE BOTTLES

(71) Applicant: Igor Svechin, Netania (IL)

(72) Inventor: Igor Svechin, Netania (IL)

( * ) Notice: Subject to any disclaimer, the term of this patent is extended or adjusted under 35 U.S.C. 154(b) by 299 days.

(21) Appl. No.: 16/639,574

(22) PCT Filed: Aug. 21, 2018

(86) PCT No.: PCT/IL2018/050922
§ 371 (c)(1),
(2) Date: Feb. 16, 2020

(87) PCT Pub. No.: WO2019/038762
PCT Pub. Date: Feb. 28, 2019

(65) Prior Publication Data

US 2020/0239202 A1 Jul. 30, 2020

(30) Foreign Application Priority Data

Aug. 22, 2017 (IL) ..... 254109

(51) Int. Cl.
*B65D 47/06* (2006.01)
*B65D 51/22* (2006.01)
*B65D 51/00* (2006.01)

(52) U.S. Cl.
CPC ..... *B65D 47/06* (2013.01); *B65D 51/007* (2013.01); *B65D 51/22* (2013.01)

(58) Field of Classification Search
CPC ..... B67B 7/26; B65D 47/06; B65D 51/007; B65D 51/22
USPC ..... 222/83, 91
See application file for complete search history.

(56) References Cited

U.S. PATENT DOCUMENTS 631,008 A * 8/1899 Goodamote ..... B65D 47/0838 222/399
757,794 A * 4/1904 Walker ..... B65D 2251/0025 222/91
1,711,537 A * 5/1929 Lewis ..... B67D 1/0456 222/511
1,759,459 A 5/1930 Murdock
1,763,924 A 6/1930 Erwin
2,015,158 A * 9/1935 Rosenberg ..... B67B 7/26 222/510
2,091,737 A * 8/1937 Longway ..... B67D 1/0456 279/42
2,184,263 A * 12/1939 Adler ..... B67B 7/26 30/443
2,241,097 A * 5/1941 Mezzapesa ..... B67D 1/0425 222/401
2,384,206 A 9/1945 Stow
2,698,113 A 12/1954 Linton
4,778,081 A * 10/1988 Vaughan ..... B67D 1/0456 222/83.5
2004/0210207 A1* 10/2004 Amisar ..... A61J 1/1418 604/415
2009/0008357 A1* 1/2009 Azodi ..... B67D 3/0032 215/316
2015/0014354 A1* 1/2015 Kellenberger ..... B65D 81/3876 222/83

* cited by examiner

*Primary Examiner* — Paul R Durand
*Assistant Examiner* — Michael J. Melaragno

(57) ABSTRACT

A dispensing mechanism for carbonated beverage bottles that includes connecting member, perforating mechanism, and opening mechanism.

1 Claim, 4 Drawing Sheets

DISPENSING MECHANISM FOR CARBONATED BEVERAGE BOTTLES

RELATED APPLICATIONS

This application is a National Phase of PCT Patent Application No. PCT/IL2018/050922 having International filing date of 21 Aug. 2018, which claims the benefit of priority of Israeli patent application No. 254109 filed on Feb. 22, 2017. The contents of the above applications are all incorporated by reference as if fully set forth herein in their entirety.

TECHNICAL FIELD

The present invention refers to a dispensing Mechanism for carbonated beverage bottles.

BACKGROUND ART

It is known that when consumers open a bottle of carbonated beverage the beverage is highly lose its carbonation. It is also known that the consumers prefer to keep and maintain the carbonation in the beverage as much as possible when opening and pouring the bottle for further consumption. The present application discloses a dispensing Mechanism that provides good solution for this problem.

DESCRIPTION OF THE DRAWINGS

The intention of the drawings attached to the application is not to limit the scope of the invention and its application. The drawings are intended only to illustrate the invention and they constitute only one of its many possible implementations.

THE INVENTION

Figure 1:
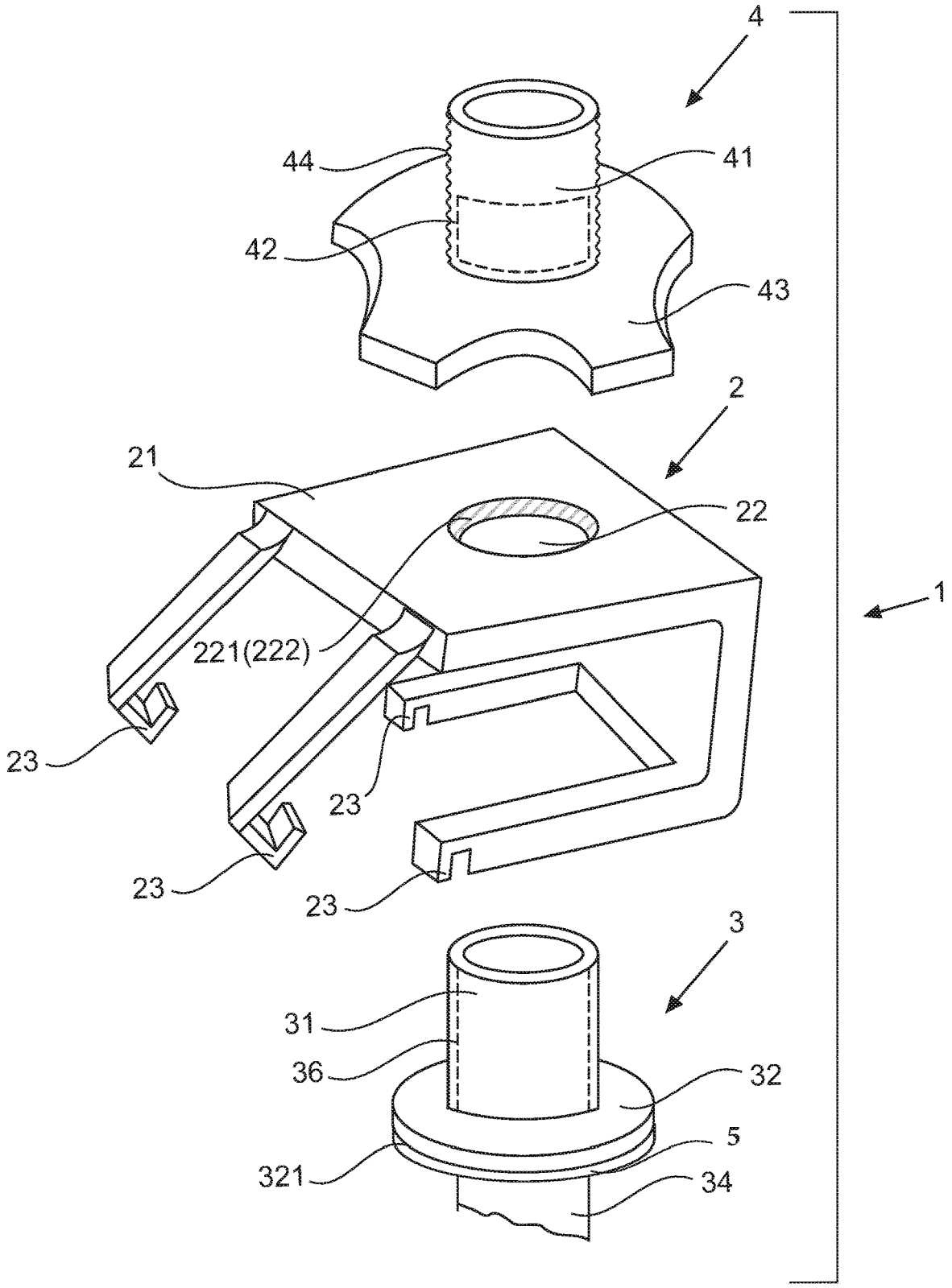
FIGS. 1 and 2 describe the dispensing mechanism (1) and its connecting member (2), perforating mechanism (3) and opening mechanism (4).

The object of the present invention is to provide a dispensing Mechanism (1) that is designed to reduce the evaporation of the carbonation when opening and pouring the drink from a carbonated beverage bottle.

The dispensing Mechanism (1) includes a connecting member (2), a perforating mechanism (3), and an opening mechanism (4). The dispensing mechanism (1) is designed to be assembled and functioned on the original cap (100) of a beverage bottle (200) while this original cap is in a closed state.

The connecting member (2) includes an upper piece (21) with a hole (22) and a locking means (23) such as described for example in the figures. The inner wall (221) of the hole (22) includes internal threads (222). It is possible that the connecting member (2) will be made of plastic as one single piece.

The perforating mechanism (3) includes a hollow tube (31) that includes a circumferential disc (32). The hollow tube (31) includes external threads (36). It is possible that the perforating mechanism (3) will be made of plastic as one single piece. To the hollow tube (31) is connected a perforating means (34), such as a knife or any kind of sharp piece, preferably made of metal.

The opening mechanism (4) includes a hollow tube (41) with internal threads (42) and external threads (44) and rotating means (43), such as a handle or disc. It is possible that the opening mechanism (4) will be made of plastic as one single piece.

Assembling and connecting the dispensing Mechanism (1): screwing the hollow tube (31) of the perforating mechanism (3) through the hole (22) of the connecting mechanism (2) till the circumferential disc (32) is attached and tightened to the bottom side of the upper piece (21) of the connecting mechanism (2). Then, screwing the opening mechanism (4) on the hollow tube (31) of the perforating mechanism (3) till it is screwed inside the hollow tube (41) of the opening mechanism (4).

The hollow tube (41) of the opening mechanism (4) is designed to receive a standard sport cap (300) or a standard faucet (400), just by screwing this sport cap or faucet, which has internal threads, on the external threads (44) of the opening mechanism (4). Using of the dispensing mechanism (1): assembling and connecting the connecting member (2) on the original cap (100) of a beverage bottle (200) and closing it on this original cap by the locking mechanism (23). Then, rotating the rotating means (41) which in turn rotate downward the perforating mechanism (3) and as a result the perforating means (34) makes a hole in the top of the original cap (100). Then, the user turns up side down the beverage bottle, open the sport cap (300) or the faucet (400) and pour the drink that stream through the hollow tubes (31) and (41) to the sport cap (300) or the faucet (400) for consumption. After that, the user closes the sport cap or the faucet for further use. In this process the carbonation is not likely to evaporate as in case of the standard opening method of the original cap.

It is possible that the to the bottom side (321) of the circumferential disc (32) will be attached a soft ring (5) so when the dispensing mechanism (1) is locked onto the original cap (100) the soft ring (5) is positioned between the bottom side (321) of the circumferential disc (32) and the original cap (100). Then, when rotating the rotating means (41) downward then perforating means (34) starts to perforates the original cap (100) and in the same time the soft ring (5) is squeezed and prevent the possibility that drink will leak out through the gap between the circumferential disc (32) and the original cap (100).

Figure 2:
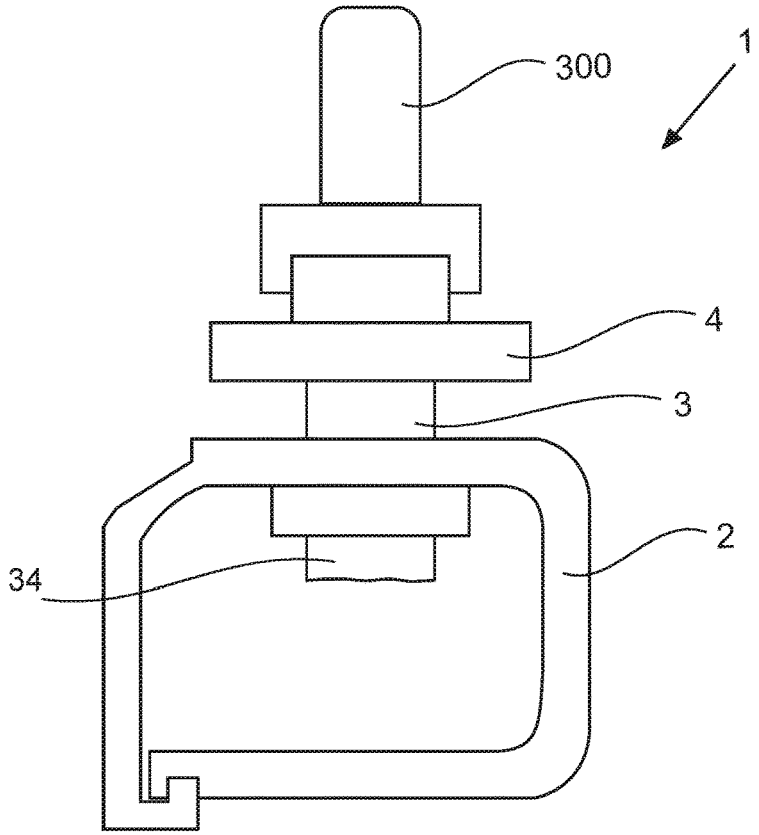

FIGS. 1 and 2 describe the dispensing mechanism (1) and its connecting member (2), perforating mechanism (3) and opening mechanism (4).

Figure 3:
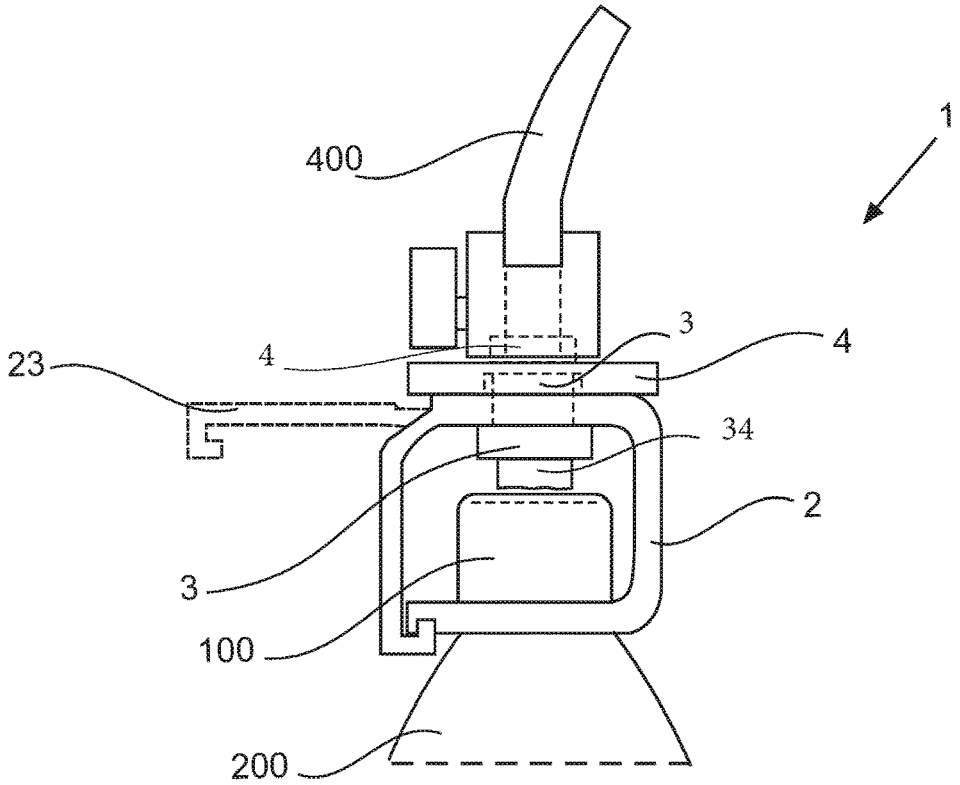
FIG. 3 describes the dispensing mechanism (1) assembled and connected on a beverage bottle (200).

FIG. 3 describes the dispensing mechanism (1) assembled and connected on a beverage bottle (200).

Figure 4:
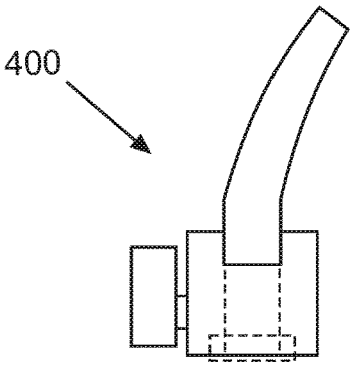
FIG. 4 describes a standard faucet (400) for beverage bottles.

FIG. 4 describes a standard faucet (400) for beverage bottles.

Figure 5:
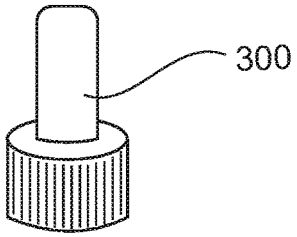
FIG. 5 describes a standard sport cap (300) for beverage bottles.

FIG. 5 describes a standard sport cap (300) for beverage bottles.

Figure 6:
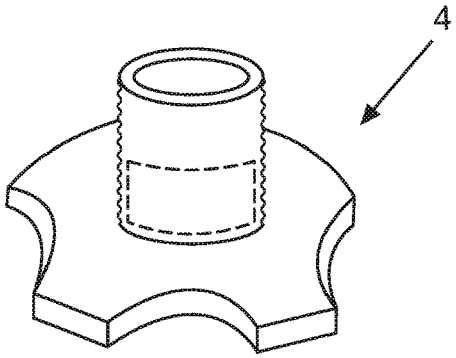
FIG. 6 describes the opening mechanism (4).

FIG. 6 describes the opening mechanism (4).

Figure 7:
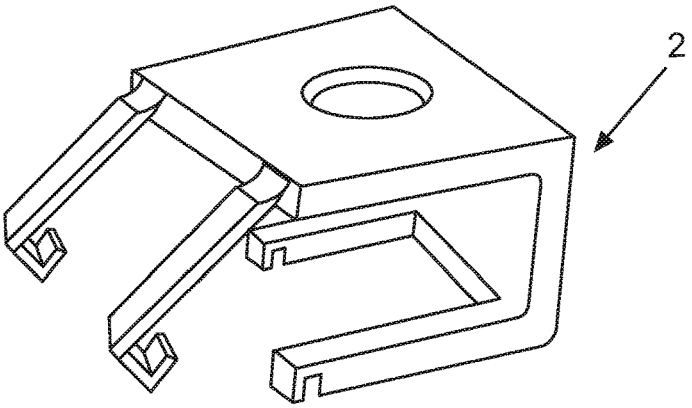
FIG. 7 describes the connecting member (2).

FIG. 7 describes the connecting member (2).

Figure 8:
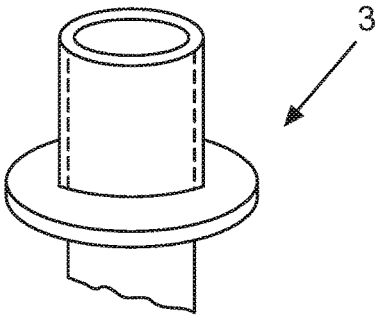
FIG. 8 describes the perforating mechanism (3).

FIG. 8 describes the perforating mechanism (3).

Figure 9:
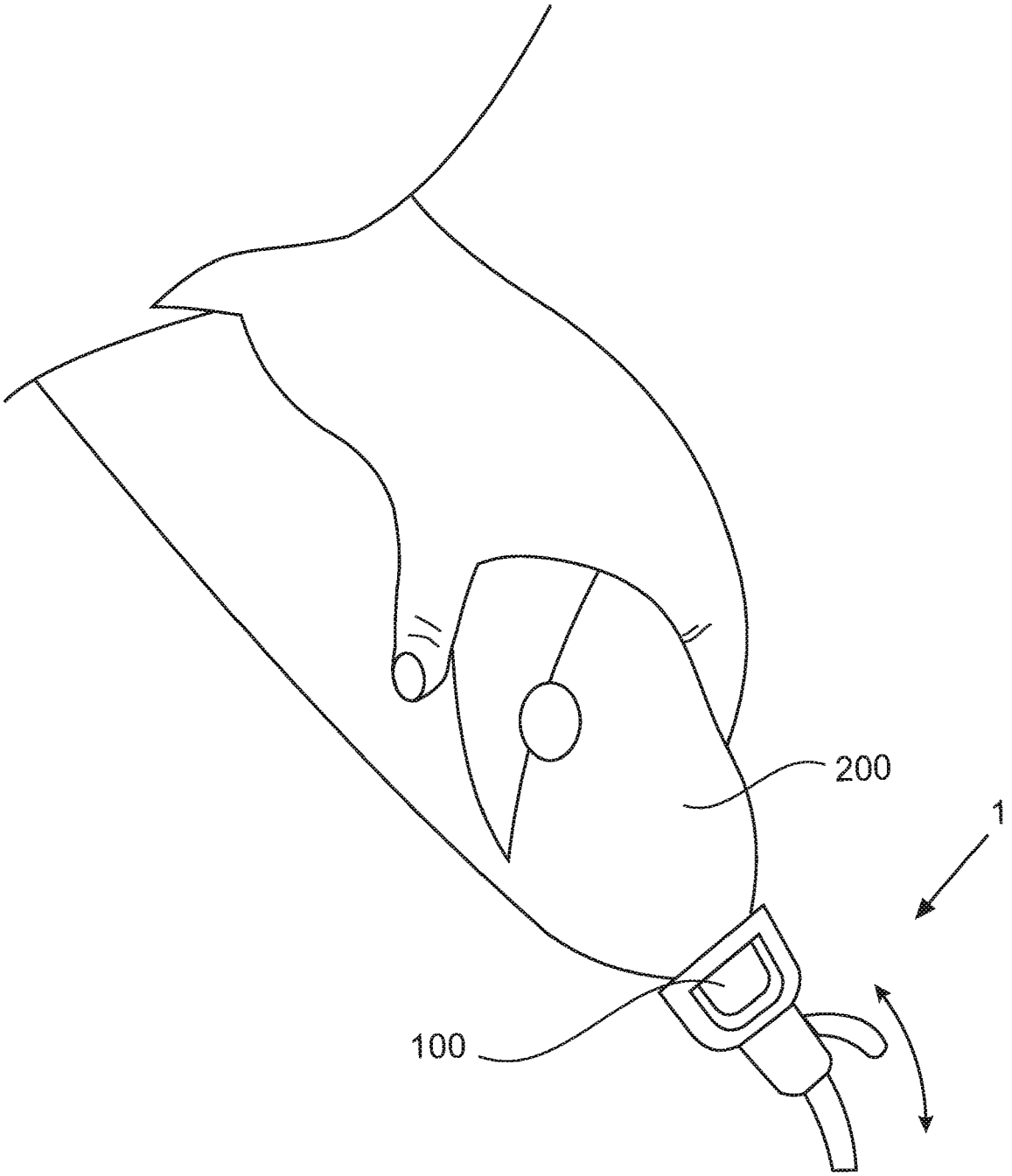
FIG. 9 describes the dispensing mechanism (1) assembled on a beverage bottle (200) in use.

FIG. 9 describes the dispensing mechanism (1) assembled on a beverage bottle (200) in use.

What is claimed is:

1. A dispensing mechanism for carbonated beverage bottles, comprising: a connecting member, a perforating mechanism, a perforating means, and an opening mechanism;

wherein the connecting member includes an upper piece with a hole with internal threads, and a locking means;

wherein the perforating mechanism includes a hollow tube that includes a circumferential disc; wherein said perforating means is connected to said hollow tube of said perforating mechanism; wherein said hollow tube of said perforating mechanism includes external threads;

wherein the opening mechanism includes a hollow tube with internal threads and external threads, and a rotating means; wherein said hollow tube of said opening mechanism is designed to receive a sport cap or a faucet;

wherein said connecting member, perforating mechanism, and opening mechanism are designed to be assembled and connected one with the other.

* * * * *